US006226902B1

(12) United States Patent
Heyne

(10) Patent No.: US 6,226,902 B1
(45) Date of Patent: May 8, 2001

(54) OPERATOR PRESENCE SYSTEM WITH BYPASS LOGIC

(75) Inventor: Dennis J. Heyne, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/354,480

(22) Filed: Jul. 16, 1999

(51) Int. Cl.[7] ..... E02F 3/32
(52) U.S. Cl. ..... 37/348; 414/699
(58) Field of Search ..... 701/45, 50; 414/699, 414/685; 130/271, 273, 272, 269, 286; 91/449, 427; 37/443, 348; 172/1–12

(56) References Cited

U.S. PATENT DOCUMENTS

| | | |
|---|---|---|
| 3,511,328 | 5/1970 | Webb . |
| 3,569,726 | 3/1971 | Reid et al. . |
| 3,838,748 | 10/1974 | Gray et al. . |
| 4,294,327 | 10/1981 | Howard . |
| 4,385,863 | 5/1983 | Minor . |
| 4,389,154 | 6/1983 | Minor et al. . |
| 4,476,964 | 10/1984 | Broman . |
| 4,607,199 | 8/1986 | Krueger et al. . |
| 4,664,218 | 5/1987 | Graham et al. . |
| 4,699,561 | 10/1987 | Tee . |
| 5,203,440 | 4/1993 | Peterson, Jr. et al. . |
| 5,425,431 | 6/1995 | Brandt et al. . |
| 5,481,078 | 1/1996 | Asche . |
| 5,551,523 | 9/1996 | Berg et al. . |
| 5,577,876 | 11/1996 | Haeder et al. . |

OTHER PUBLICATIONS

Case Loader/Backhoe Brochure, 580L, Case Corporation, Racine, WI, 1996.

*Primary Examiner*—Robert E. Pezzuto
(74) *Attorney, Agent, or Firm*—Foley & Lardner

(57) ABSTRACT

A work vehicle includes a frame, an excavating apparatus movably secured to the frame, an operator's station, and a control system. The excavating apparatus includes a material engaging member and a plurality of actuators having positions for positioning the material engaging member with respect to the frame. The control system controls the positions of the plurality of actuators and thereby the position of the material engaging member. The controls system includes a plurality of manual operator input devices, an operator presence sensor, a control circuit, and an override device. The plurality of manual operator input devices are located at the operator station for providing material engaging member position commands. The operator presence sensor is configured to generate an operator presence signal. The control circuit is configured to receive the operator presence signal, to enable the providing of material engaging member position commands when the operator is disposed at a first operator position and to disable the providing of material engaging member position commands when the operator is away from the first operator position. The override device bypasses the presence sensor and is manually engagable by the operator. The control circuit is configured to enable the providing of material engaging member position commands when the override device is manually engaged.

22 Claims, 3 Drawing Sheets

FIG. 2
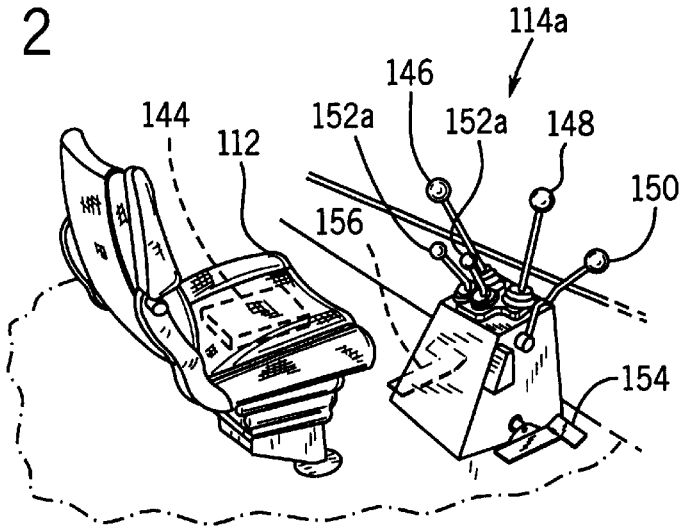
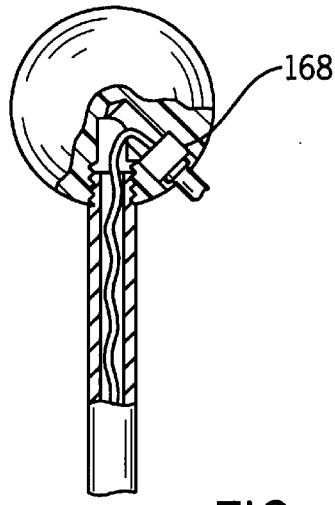
FIG. 4
FIG. 3
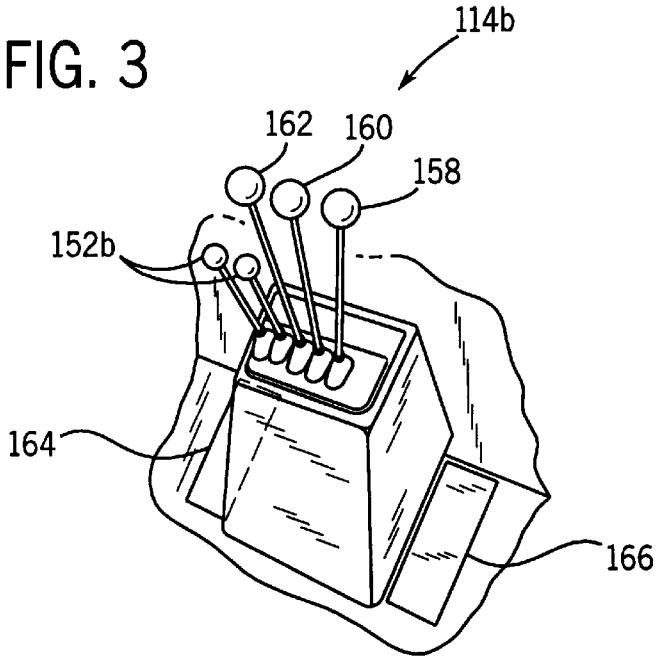

OPERATOR PRESENCE SYSTEM WITH BYPASS LOGIC

FIELD OF THE INVENTION

The present invention relates generally to work vehicles having excavating apparatus and first and second sensors of presence of an operator. More particularly, the present invention relates to backhoes having an override device of an operator first position presence sensor.

BACKGROUND OF THE INVENTION

Work vehicles often include, as in the case of construction equipment (e.g., front end loaders and backhoes), attached implements such as buckets for tasks such as excavating soil. Such implements include actuators, often in the form of hydraulic cylinders, which are controlled by operator commands transmitted to an implement position control system by using operator manual input devices such as levers, joysticks, pedals, knobs or the like.

A work vehicle is generally provided with an operator station having a seat located for good visibility of the work being done by the implement and for best access to the operator input devices. To preclude operation of the implement with an operator not properly positioned at the operator input devices, an operator presence sensor may be provided in the form of a seat switch; i.e., a switch located within or under the seat and disposed to change state when the operator is seated and his weight is borne by the seat. Actuation of the seat switch upon seating of the operator typically provides a signal to an implement control system which enables response of the actuators to operator commands, while rising of the operator from the seat disables at least a portion of the implement by causing a least a portion of the control system to no longer respond to operator commands and to instead cause the portion of the implement to remain in the position it was disposed in upon the rising of the operator from the seat.

In some cases, however, an operator may prefer to briefly stand at the operator input devices so that, while remaining in a position suitable for manipulating the operator input devices, he may obtain a better view of work in progress; e.g., excavating of a deep trench with a backhoe. He is not able to do so, however, if a presence sensor such as a seat switch will disable actuator response to his implement position commands.

It would be advantageous to provide for a work vehicle having an implement including actuators, an operator's seat in the region of operator input devices, and an implement position control system including an implement disabling circuit associated with the seat, to include an override device for allowing continuing enablement of the operator input devices for so long as the operator remains engaged with the override device regardless of the operator's position with respect to the seat.

It would also be advantageous to provide for such an override device to be in the general nature of a momentary contact switch affixed to at least one of the operator input devices, the control system configured for engagement of the momentary contact switch to have effect when engaged by the operator prior to his rising from the seat.

SUMMARY OF THE PRESENT INVENTION

The present invention relates to a backhoe having a plurality of actuators having positions for positioning of a digging bucket of the backhoe, an operator station having a first position of an operator and a second position of the operator, and a control system configured for controlling position of the bucket in response to bucket position commands. The control system includes a plurality of manual operator input devices located at the operator's station for providing the bucket position commands, a first operator presence sensor associated with the first operator position and a second operator presence sensor associated with the second operator position.

Another aspect of the present invention relates to a work vehicle including a frame; an excavating apparatus movably secured to the frame, including a material engaging member and a plurality of actuators having positions for positioning the material engaging member with respect to the frame; an operator's station and a control system for controlling the positions of the plurality of actuators and thereby the position of the material engaging member. The control system includes a plurality of manual operator input devices located at the operator's station for providing material engaging member position commands; an operator presence sensor associated with the seat, configured to enable the providing of material engaging member position commands when the operator is disposed in a first operator position and to disable the providing of material engaging member position commands when the operator is away from the first operator position; and an override device for bypassing the presence sensor, the override device being manually engageable by the operator.

Another aspect of the present invention relates to a control system for positioning a material engaging member of a material excavating apparatus associated with a work vehicle, the work vehicle having an operator's station and a seat associated with the operator's station, the excavating apparatus movably secured to a frame of the work vehicle, the excavating apparatus including a plurality of actuators having positions for positioning the material engaging member with respect to the frame. The control system includes a plurality of manual operator input devices located at the operator's station for providing material engaging member position commands; an operator presence sensor associated with the seat, configured to enable the providing of material engaging member position commands when the operator is disposed in a first operator position and to disable the providing of material engaging member position commands when the operator is disposed away from the first operator position; and an override device for bypassing the presence sensor, the override device being manually engageable by the operator.

Another aspect of the present invention relates to a method of overriding a disablement system for an implement attached to a work vehicle, the work vehicle including an implement control system having operator input devices for operator inputs and configured to disable the implement in the absence of a signal indicative of operator presence provided by an operator presence sensor, and an operator's station having an operator's seat in the region of the operator input devices, the method including the steps of sitting in the seat to provide the signal indicative of operator presence; engaging a manual override device associated with the operator input devices after the step of sitting; and maintaining engagement of the manual override device while rising from the seat to override the disablement system after the step of engaging.

Other principal features and advantages of the invention will become apparent to those skilled in the art upon review of the following drawings, the detailed description and the appended claims.

BRIEF DESCRIPTION OF THE DRAWINGS

FIG. 2 is a fragmentary perspective view of an operator's station including a plurality of operator input devices;

FIG. 3 is a fragmentary perspective view of an alternative configuration of a plurality of operator input devices;

FIG. 4 is a fragmentary elevation view of an operator input device having an override switch;

Figure 1:
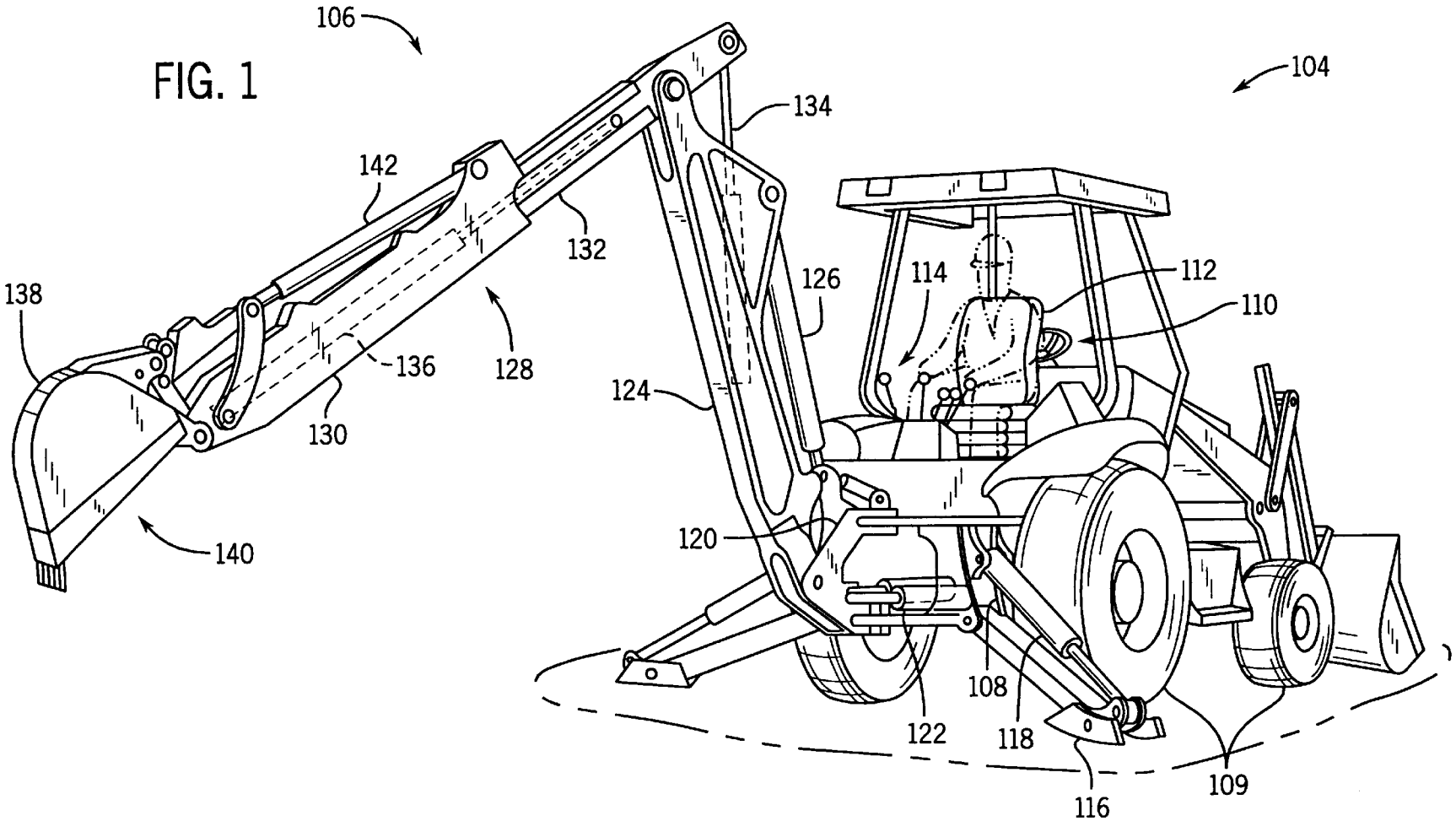
FIG. 1 is a perspective view of a preferred embodiment in which a work vehicle is provided with an attached implement.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

FIG. 1 shows a work vehicle 102 including a tractor 104 and a soil excavating implement, or backhoe 106. Tractor 104 includes a frame 108 supported by wheels 109, crawler treads, or the like, as well as an operator's station 110 having a seat 112 and an operator input device console 114.

Backhoe 106 includes a material engaging member shown as a bucket 138 having an opening 140 and a plurality of members for positioning of bucket 138, those members shown as a swing tower 120 affixed to frame 108, a boom 124 movably secured to swing tower 120, and a dipperstick 128 movably secured to boom 124. Bucket 138 is movably secured to dipperstick 128. Tractor-mounted backhoe 106 is shown as a L-Series Loader/Backhoe provided with an Extendahoe® dipperstick, both produced by Case Corporation, assignee of the present invention. Dipperstick 128 includes a first portion 130 and a second portion 132 which is telescoped with respect to first portion 130, thereby providing bucket 138 with a greater reach from tractor 104.

Figure 5:
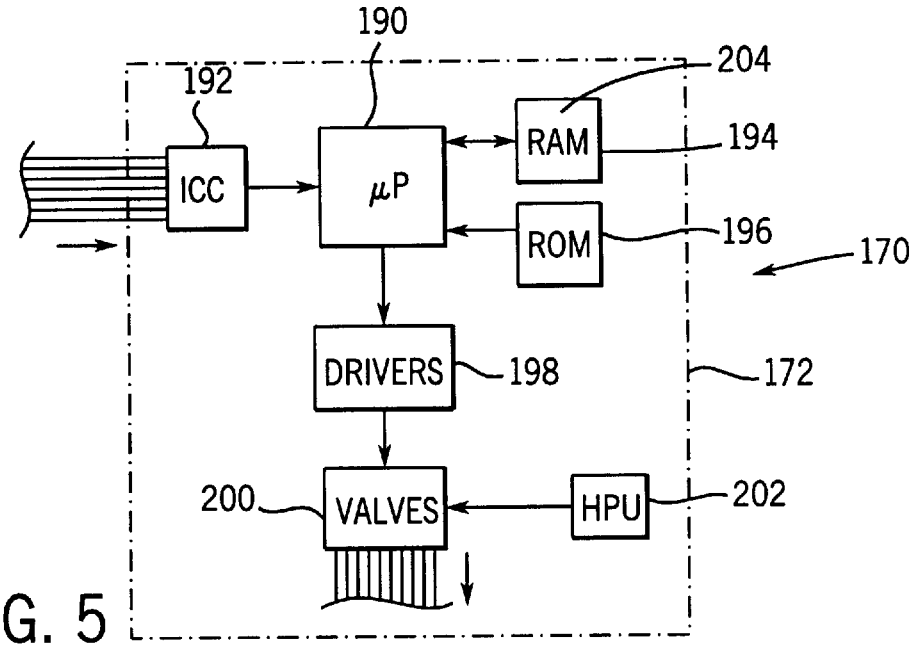
FIG. 5 is a block diagram of an implement control system.

A plurality of actuators is used to position the members described above with respect to each other and to thereby position bucket 138 with respect to frame 108. The actuators are shown as hydraulic cylinders and include a left-side swing cylinder 122 and a right-side swing cylinder (not shown but configured as a mirror image of left-side swing cylinder 122); a boom cylinder 126; a dipperstick cylinder 134; and a bucket cylinder 142. Dipperstick 128 includes a dipperstick extension cylinder 136. Left-side swing cylinder 122, right-side swing cylinder 122*b*, boom cylinder 126, dipperstick cylinder 134, extension cylinder 136, and bucket cylinder 142 are controlled by an operator disposed at operator's station 110, generally in a first operator position upon seat 112 which is located and disposed for a good operator view of the work being performed by bucket 138 and for good access to manual operator input devices, or operator input devices (FIGS. 2 and 3), which are located at console 114 and are used to provide operator input or commands, to a bucket position control system 170 (FIG. 5). Work vehicle 102 may also include stabilizers 116, which are positioned by the operator using operator input devices at console 114. The operator input devices extend stabilizer cylinders 118 to position stabilizers 116 into contact with the soil.

FIG. 2 shows a preferred embodiment of a portion of operator's station 110 including seat 112 and a console 114*a*. Seat 112 is shown in a rearward facing position, oriented for operation of backhoe 106, and may be reoriented to a forward facing position for driving of work vehicle 102. Console 114*a* includes a plurality of operator input devices, shown as levers and pedals, which are used by the operator to provide bucket position commands to control system 170 (FIG. 5). Bucket position commands may be provided by positioning of spools within hydraulic directional and flow control valves, with the spools mechanically connected to operator input devices; in the form of hydraulic pressure signals from pilot valves connected to operator input devices and routed to pilot-controlled directional and flow control valves; and/or in the form of electronic signals from transducers (e.g., potentiometers, variable differential transformers, encoders) coupled to operator input devices and controlling hydraulic valve drivers through control system 170. Electronic signals may be analog (e.g., voltage or current level), pulse width modulated (PWM), or digitally encoded.

Operator input devices located at or upon console 114*a* include a dipperstick/swing joystick 148, a boom/bucket joystick 146, and stabilizer levers 152*a*. In alternative embodiments, pedals 154 and 156 may be included for auxiliary functions of generally unrelated accessories, or may be used to control swing and the dipperstick/swing joystick replaced by a dipperstick (only) lever. Dipperstick/swing joystick 148 is pushed away from the operator to command dipperstick 128 to move away from the operator, pulled toward the operator to command dipperstick 128 to move toward the operator, pushed to the operator's left to command boom 124 to swing to the operator's left, and pushed to the operator's right to command boom 124 to swing to the operator's right. Boom/Bucket joystick 146 is pushed away from the operator to command boom 124 to move away from the operator, pulled toward the operator to command boom 124 to move toward the operator, pushed to the operator's left to command bucket 138 to tilt opening 140 up, and pushed to the operator's right to command bucket 138 to tilt opening 140 down. Stabilizer levers 152*a* are pushed away from the operator to command the corresponding stabilizers 116 to lower and pulled toward the operator to command the corresponding stabilizers 116 to raise. Pedals 154, 156 may be used to control flow of hydraulic fluid to accessories, e.g., hydraulic torque wrenches, dewatering pumps, etc.

A first operator presence sensor is shown, for example, as a seat switch 144 located within seat 112, and is configured and disposed to change state (i.e., to open or close electrical contacts) when weight is placed upon seat 112. Seat switch 144 is coupled to control circuit 172 (e.g., through a chassis wiring harness or through a vehicle CAN bus). Control system 170 (shown in FIG. 5) is configured to enable operator input device of the position of bucket 138 (e.g., by coupling operator input devices to valve drivers) when a weight is sensed (i.e., when an operator is seated) and to disable operator input device of the position of bucket 138 (e.g., by uncoupling operator input devices from valve drivers) when a weight is not sensed (i.e., when seat 112 is vacant in a manner discussed more fully below).

In an alternative embodiment, a seat switch may be located under seat 112, i.e., within support structure for seat 112 or between the support structure and the floor of operator's station 110. In another alternative embodiment, a load cell may be used instead of a switch to sense weight upon seat 112, a signal corresponding to the weight sensed sent to control system 170, and digital logic used within control system 170 to enable or disable operator input device of bucket position in correspondence with a predetermined threshold signal level corresponding to the amount of weight upon seat 112. In any preferred embodiment, the amount of weight required for a change of state in bucket position control enablement is approximately 30 pounds to preclude inadvertent enablement (e.g., by debris in the seat) and inadvertent disablement (e.g., by transient unweighting due to the operator shifting his position in the seat).

FIG. 3 shows an alternative embodiment of an operator input device console, in which a console 114*b* is provided with a plurality of levers, which are grouped in an in-line relationship, and with two pedals. A boom lever 158 is pushed away from the operator to command boom 124 to move away from the operator and pulled toward the operator to command boom 124 to move toward the operator. A dipperstick lever 160 is pushed away from the operator to command dipperstick 128 to move away from the operator and pulled toward the operator to command dipperstick 128 to move toward the operator. A bucket lever 162 is pushed away from the operator to command bucket 138 to tilt opening 140 down and pulled toward the operator to command bucket 138 to tilt opening 140 up. Either or both stabilizer levers 152*b* are pushed away from the operator to command the corresponding stabilizers 116 to lower and pulled toward the operator to command the corresponding stabilizers 116 to raise. A right-side swing pedal 166 is depressed to command boom 124 to swing to the operator's right, and a left-side swing pedal 164 is depressed to command boom 124 to swing to the operator's left.

Various control console configurations including variations in combinations of levers, joysticks and pedals are generally available, and one of them is specified or selected by a purchaser of backhoe 106 at the time of purchase. Each configuration generally conforms to one of a variety of defacto industry standards in control element location and range of motion, each such defacto standard relating to a particular backhoe manufacturer's preferred or customary arrangement and implementation of such control elements. The two configurations discussed above and shown in FIGS. 2 and 3 shall be understood to be merely typical and representative, and not all-inclusive.

FIG. 4 shows an operator input device lever or joystick provided with a second operator presence sensor, shown as an override switch 168. Override switch 168 is a momentary contact switch; i.e., a switch which changes state only while engaged by the operator and which includes a spring for automatic return to a default, nonengaged position when released by the operator. Override switch 168 is coupled to a microprocessor 190 of control system 170, and is used by the operator to override a disabling of bucket position control which would otherwise occur when he rises from the first operator position in seat 112 to stand in a second operator position near seat 112 (e.g., to temporarily position bucket 138 at the bottom of a deep trench not sufficiently visible from the seated position). In a preferred embodiment, override switch 168 is secured to boom/bucket joystick 148 of console 114*a* (or to boom lever 158 of console 114*b*) and control system 170 is configured to allow override of disablement of bucket position control (i.e., to allow continued bucket position control) when the seated operator depresses override switch 168 and then rises from seat 112 while holding override switch 168 depressed. The operator is thereby able to control position of backhoe 106 while in a standing position at console 114, provided he has depressed override switch 168 prior to rising from seat 112, for as long as he continuously maintains engagement with override switch 168, i.e., holds override switch 168 depressed.

In a particularly preferred embodiment, two operator input devices are provided with override switches 168 so that the operator may maintain bucket position control from a standing position by depressing and maintaining depressed either of override switches 168 before rising from seat 112, and then depressing and maintaining depressed the other override switch 168 before releasing the initially depressed override switch 168 if he wishes to switch hands (e.g., to manipulate another lever located on the same side of console 114 as is the initially depressed override switch. One of the two override switches 168 is secured to boom lever 158 and the other of the override switches 168 is secured to bucket lever 162. In this embodiment, the operator does not have to sometimes cross hands (i.e., manipulate an operator input device on his left side with his right hand or conversely).

In alternative embodiments (not shown), presence of an operator disposed at control console 114 in seated and/or standing positions may be sensed by a sensor which generates a signal when impinged upon by a beam of energy transmitted from an aligned source of energy; e.g., a photodiode receiving a narrow beam of infrared light from an aligned, collimating infrared lamp or light-emitting diode. A photodiode changes state when light having flux above a threshold value is beamed upon it and the beam is not interrupted. While light sources and photodiodes are available in both visible and invisible spectrums, an invisible spectrum (e.g., infrared) is preferred to preclude inadvertent photodiode change of state in conditions of high ambient brightness, e.g., bright sunlight.

The light source is disposed on one side of the operator and the sensor on the other. When the operator is present his body interrupts the light beam and the sensor does not sense the light, whereas when the operator is absent the light beam reaches the sensor and the sensor senses the light. In one such alternative embodiment, light beams may be oriented transversely with respect to tractor 104 with a first light source and a first photodiode located in correspondence with the seated position of the operator, and a second light source and a second photodiode located in correspondence with the standing position of the operator. In another such alternative embodiment, a single light source may be located behind the operator and aimed toward a single photodiode disposed in front of the operator, the operator thereby interrupting the light beam in both seated and standing positions.

FIG. 5 shows a preferred embodiment of bucket position control system 170 including a control circuit 172. Control system 170 includes a microprocessor 190, a random-access memory (RAM) 194, a nonvolatile read-only memory (ROM) 196, a driver circuit 198 and an input conditioning circuit (ICC) 192. RAM 194, ROM 196, ICC 192 and driver circuit 198 are in communication with microprocessor 190, e.g., through a bus. Microprocessor 190 communicates and executes command instructions in accordance with a program 204 stored in ROM 196, and stores data in specific addressed registers within RAM 194. When instructed by a command from program 204, microprocessor 190 retrieves data from a specific address within RAM 194 and utilizes it in executing program 204.

Bucket position control system 170 performs various activities related to the positioning of bucket 138 with respect to frame 108, among those activities being the enabling and disabling of actuator response to operator input device (i.e., operator input) bucket position commands. The enabling and disabling activities are performed by microprocessor 190 within control system 170 in accordance with data retrieved by microprocessor 190 from RAM 194 as directed by program 204 instructions. These data include representations of operator presence or lack of presence in seat 112 or at console 114. These representations were placed in RAM 194 by microprocessor 190 in accordance with program 204 instructions received from ROM 196 and represent a presence signal received through ICC 192 from seat switch 144 and an override signal received through ICC 192 from override switch 168. Microprocessor 190 enables operator input control of bucket 138 position by accepting, processing and transmitting (when data in RAM indicates that an operator is present) to driver circuit 198 signals generated by operator input devices at console 114, and disables such control (when data in RAM does not indicate that an operator is present) by not accepting, processing and/or transmitting the operator input signals.

ICC 192 includes signal modulating and converting (e.g., analog-to-digital or A/D) apparatus typical of vehicular and equipment electronics. If control system 170 acquires data from other sources (e.g., cylinder position sensors), a multiplexer may be included to sample signals into a single A/D converter. Driver circuit 198 processes and converts control signals generated by microprocessor 190 in accordance with program 204 in order to make them compatible with bucket 138 positioning cylinders, e.g., digital-to-analog (A/D) conversion, pulse width modulation (PWM) and voltage or current modulation for use in, e.g., hydraulic directional and flow control valves located in the paths of flow from a hydraulic power unit (HPU) 202 to left- and right-side swing cylinders 122 and respectively, boom cylinder 126, dipperstick cylinder 134, extension cylinder 136 and bucket cylinder 142.

Figure 6:
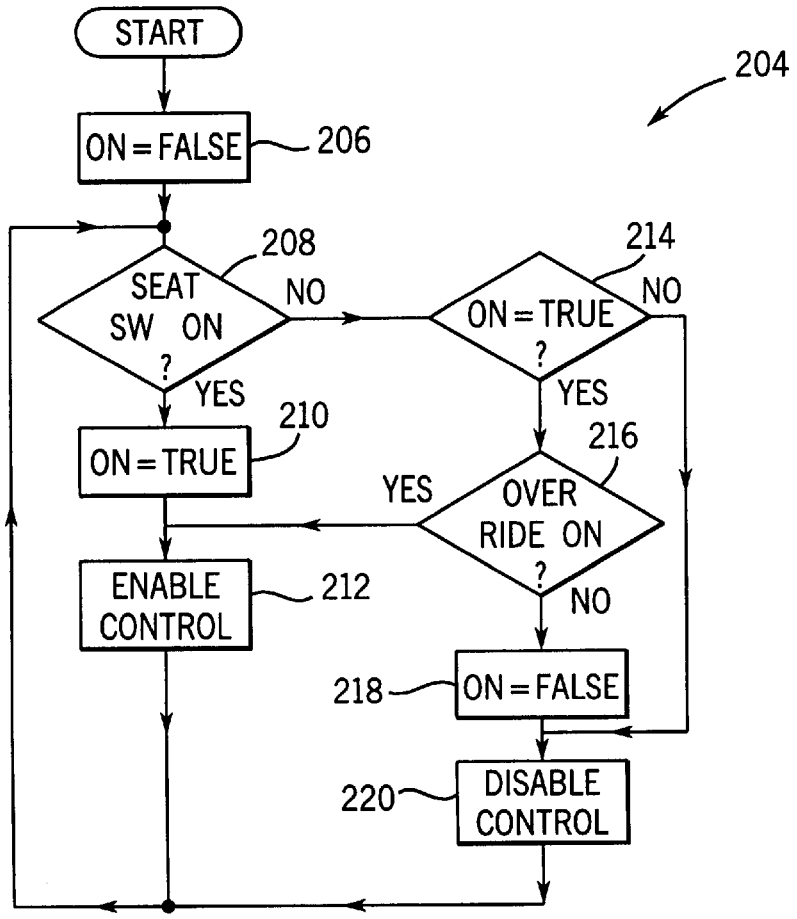
FIG. 6 is a schematic diagram of a portion of a program for the control system of FIG. 5.

FIG. 6 shows schematically a preferred embodiment of a portion of program 204 stored within ROM 196, that portion dealing with enabling and disabling of bucket 138 position control by effectively connecting or disconnecting, respectively, the operator input devices on console 114*a* or 114*b* with respect to control circuit 172, or effectively disabling control circuit 172 of control system 170. In alternative embodiments, ICC 192 may be connected or disconnected with respect to microprocessor 190 and/or microprocessor 190 with respect to driver circuit 198.

Program 204 first sets a flag "ON" to "false" in block 206. Microprocessor 190 then checks seat switch 144 to determine if the operator is present on seat 112 in block 208. If the operator is present on seat 112, the "ON" flag is set to "true" in block 210 and control circuit 172 response to any bucket 138 position command generated by the operator is enabled in block 212. When thus enabled, microprocessor 190 translates the operator's movement of the operator input devices into signals that are applied to valve drivers 198 to provide the commanded motions. Program 204 execution then returns to block 208 and seat switch 144 is tested again. The above seat-checking and enabling operation is repeated indefinitely as long as the operator is present on seat 112. Thus, for as long as the operator is present on seat 112, control circuit 172 will respond to the operator commands.

When the operator leaves seat 112, however, program 204 flow changes. If the operator holds override switches 168 down, control circuit 172 is still enabled (not disabled) for as long as the operator is out of seat 112. When the operator leaves seat 112, the "Seat Switch 'On'?" test of block 208 fails, and program 204 flow branches to block 214. In block 214, microprocessor 190 checks to see if the "ON" flag is set to "true." Assuming the operator has never left seat 112 since program 204 execution began, the "ON" flag will be "true," and program 204 flow will branch to block 216 in which microprocessor 190 determines if override switches 168 are being actuated by the operator. If they are, microprocessor 190 will branch to the "yes" path out of block 216 and control will be enabled, as discussed above, in block 212. Again, program 204 execution returns to block 208 and microprocessor 190 repeatedly checks the "ON" flags of blocks 208, 214 and 216 and enables the operator input devices indefinitely. Thus, when the operator actuates override switches 168 before leaving seat 112, the operator input devices are still enabled and are maintained enabled for so long as override switches 168 are actuated by the operator.

When the operator releases override switches 168 while out of seat 112, however, the operator input devices are disabled. In this situation, program 204 executes block 208, thereby determining that the operator is not present in seat 112, then executes block 214 thereby determining that the "ON" flag is "true" just as in the previous paragraph. When performing the override switch test in block 216, however, microprocessor 190 determines that override switches 168 have been released (i.e., the override is "off") and branches to block 218 where the "ON" flag is set to "false," and thence to block 220 where the operator input devices are disabled. After block 220, program 204 again returns to block 208 to check seat switch 144 and branches to block 214 to check the "ON" flag, since the operator is still out of seat 112. This time, however, since the "ON" flag is "false," program 204 execution branches directly to block 220 where control circuit 172 is disabled. Program 204 execution cycles through blocks 208, 214 and 220, keeping control circuit 172 disabled indefinitely. Even if the operator again actuates override switches 168 while still not seated in seat 112, control circuit 172 will still be disabled, since program 204 flow now bypasses block 216 (the override "on" block).

The only way to re-enable operator control and to break out of the block 208, block 214, block 220 loop is for the operator to again sit in seat 112 and thereby actuate seat switch 144. This causes microprocessor 190 to answer "yes" to the seat switch test of block 208, to set the "ON" flag to "true" in block 210, and to enable the operator input device interaction with control circuit 172 in block 212.

Thus, for as long as the operator remains in seat 112 and seat switch 144 is thereby actuated, control circuit 172 is enabled. If the operator rises from seat 112 with override buttons 168 depressed, control circuit 172 remains enabled. Once the operator releases override switches 168 while out of seat 112, control circuit 172 is disabled, and remains disabled until the operator returns to seat 112. If the operator ever rises from seat 112 without override switches 168 being actuated, control circuit 172 is disabled and remains disabled until the operator returns to seat 112.

While the microprocessor-based embodiment above is preferred, the control circuitry maybe embodied in discrete digital circuits, analog circuits, hydraulic circuits, pneumatic circuits or any combination thereof.

Thus, it should be apparent that there has been provided in accordance with the present invention an operator presence system with bypass logic that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A backhoe having a plurality of actuators having positions for positioning of a digging bucket of the backhoe, an operator station having a first position of an operator and a second position of the operator, and a control system configured for controlling position of the bucket in response to bucket position commands, the control system including:

a plurality of manual operator input devices located at the operator's station for providing the bucket position commands;

a first operator presence sensor associated with the first operator position configured to sense operator presence in the first operator position; and a second operator presence sensor associated with the second operator position configured to sense operator presence in the second operator position.

2. The backhoe of claim 1 wherein the control system is configured to cause the plurality of actuators to maintain their positions when the bucket position commands are disabled.

3. The backhoe of claim 2 wherein the control system further includes a control circuit and the control circuit is configured to respond to the second operator presence sensor by enabling control of the actuators to move the bucket when the second operator presence sensor has been manually engaged by the operator prior to the operator leaving the first operator position and for so long as the second operator presence sensor remains manually engaged by the operator.

4. The backhoe of claim 3 wherein the operator station includes a seat and the first operator presence sensor is a switch configured and disposed to provide a presence signal when the operator is seated in the first operator position.

5. The backhoe of claim 4 wherein the second operator presence sensor includes a first momentary contact switch which is associated with a first operator input device and is configured and disposed to provide a signal indicative of operator presence when the first momentary contact switch is manually engaged by the operator.

6. The backhoe of claim 5 wherein the second operator presence sensor further includes a second momentary contact switch which is associated with a second operator input device and is configured and disposed to provide the signal indicative of operator presence when both the first and second momentary contact switches are manually engaged substantially concurrently by the operator.

7. The backhoe of claim 6 wherein the control system further includes:

a driver circuit associated with the plurality of actuators;

a microprocessor; and a nonvolatile memory device coupled to the microprocessor and including a program; wherein the microprocessor is configured by the program to communicate with the driver circuit, the memory device, the first operator presence sensor, and the second operator presence sensor to enable and disable response of the control circuit to the second operator presence sensor.

8. A work vehicle comprising:

a frame;

an excavating apparatus movably secured to the frame, including a material engaging member and a plurality of actuators having positions for positioning the material engaging member with respect to the frame;

an operator's station; and a control system for controlling the positions of the plurality of actuators and thereby the position of the material engaging member, the control system including:

a plurality of manual operator input devices located at the operator's station for providing material engaging member position commands;

an operator presence sensor configured to generate an operator presence signal;

a control circuit configured to receive the operator presence signal, to enable the providing of material engaging member position commands when the operator is disposed in a first operator position and to disable the providing of material engaging member position commands when the operator is away from the first operator position; and an override device for bypassing the presence sensor, the override device being manually engageable by the operator, wherein the control circuit is configured to enable the providing of material engaging member position commands when the override device is manually engaged.

9. The work vehicle of claim 8 wherein the control system is configured to cause the plurality of actuators to maintain their positions when the material engaging member position commands are disabled.

10. The work vehicle of claim 9 wherein the control circuit is configured to respond to the override device when the override device has been manually engaged by the operator prior to the operator leaving the first operator position and for so long as the override device remains manually engaged by the operator.

11. The work vehicle of claim 10 wherein the operator's station includes a seat and the presence sensor is a switch configured and disposed to provide a presence signal when the operator is seated in the first operator position.

12. The work vehicle of claim 11 wherein the override device includes a first momentary contact switch which is associated with a first operator input device and is configured and disposed to provide an override signal when the first momentary contact switch is manually engaged by the operator.

13. The work vehicle of claim 12 wherein the override device further includes a second momentary contact switch which is associated with a second operator input device and is configured and disposed to provide the override signal when both the first and second momentary contact switches are manually engaged substantially concurrently by the operator.

14. The work vehicle of claim 10 wherein the control circuit further includes:

a driver circuit associated with the plurality of actuators;

a microprocessor; and a nonvolatile memory device coupled to the microprocessor and including a program; wherein the microprocessor is configured by the program to communicate with the driver circuit, the memory device, the presence sensor and the override device to enable and disable response of the control circuit to the override device.

15. A control system for positioning a material engaging member of a material excavating apparatus associated with a work vehicle, the work vehicle having an operator's station and a seat associated with the operator's station, the excavating apparatus movably secured to a frame of the work vehicle, the excavating apparatus including a plurality of actuators having positions for positioning the material engaging member with respect to the frame, the control system comprising:

a plurality of manual operator input devices located at the operator's station for providing material engaging member position commands;

an operator presence sensor associated with the seat, configured to generate an operator presence signal;

a control circuit configured to receive the operator presence signal, to enable the providing of material engaging member position commands when the operator is disposed in a first operator position and to disable the providing of material engaging member position commands when the operator is disposed away from the first operator position; and an override device for bypassing the presence sensor, the override device being manually engageable by the operator, wherein the control circuit is configured to enable the providing of material engaging member position commands when the override device is manually engaged.

16. The control system of claim 15, configured to cause the plurality of actuators to maintain their positions when the material engaging member position commands are disabled.

17. The control system of claim 16 wherein the control circuit is configured to respond to the override device when the override device has been manually engaged by the operator prior to the operator leaving the first operator position and for so long as the override device remains manually engaged by the operator.

18. The control system of claim 17 wherein the presence sensor is configured and disposed to provide a presence signal when the operator is in the first operator position.

19. The control system of claim 18 wherein the override device includes a first momentary contact switch which is associated with a first of the plurality of operator input devices and is configured and disposed to provide an override signal when the first momentary contact switch is manually engaged by the operator.

20. The control system of claim 19 wherein the override device further includes a second momentary contact switch which is associated with a second of the plurality of operator input devices and is configured and disposed to provide the override signal when both the first and second momentary contact switches are manually engaged substantially concurrently by the operator.

21. The control system of claim 17 wherein the control circuit further comprises:

a driver circuit associated with the plurality of actuators;

a microprocessor; and a memory device coupled to the microprocessor and including a program; wherein the microprocessor is configured by the program to communicate with the driver circuit, the memory device, the presence sensor and the override device, and the program is configured to enable and disable response of the control circuit to the override device.

22. A method of overriding a disablement system for an implement attached to a work vehicle, the work vehicle including an implement control system having operator input devices for operator inputs and configured to disable the implement in the absence of a signal indicative of operator presence provided by an operator presence sensor, and an operator's station having an operator's seat in the region of the operator input devices, the method including the steps of:

a. sitting in the seat to provide the signal indicative of operator presence;

b. engaging a manual override device associated with the operator input devices after the step of sitting; and c. maintaining engagement of the manual override device while rising from the seat to override the disablement system after the step of engaging.

* * * * *